United States Patent [19]

Bucefari et al.

[11] Patent Number: 4,644,743

[45] Date of Patent: Feb. 24, 1987

[54] MACHINE FOR THE PRODUCTION OF ORNAMENTAL CHAINS, IN PARTICULAR OF THE PAIRED TYPE

[75] Inventors: Massimo Bucefari; Roberto Rubechini, both of Arezzo, Italy

[73] Assignees: I.C.M. S.p.A. Italiana Costruzioni Metalmeccaniche; T.E.M. s.r.l. Tecnologie Elettroniche e Meccaniche, both of Arezzo, Italy

[21] Appl. No.: 717,974

[22] Filed: Mar. 29, 1985

[30] Foreign Application Priority Data

Mar. 29, 1984 [IT] Italy ..... 9364 A/84

[51] Int. Cl.[4] ..... B21L 3/02

[52] U.S. Cl. ..... 59/31; 59/24; 59/16; 228/192

[58] Field of Search ..... 59/26, 31, 32, 34, 35.1, 59/33, 78, 24, 18, 21, 16; 228/902, 192

[56] References Cited

U.S. PATENT DOCUMENTS

| | | | |
|---|---|---|---|
| 728,119 | 8/1902 | Leuenberger | 59/31 |
| 1,833,444 | 11/1931 | Stuller | 59/21 |
| 4,275,555 | 6/1981 | Bichi | 59/31 |

*Primary Examiner*—Lowell A. Larson

*Assistant Examiner*—David B. Jones

*Attorney, Agent, or Firm*—Browdy and Neimark

[57] ABSTRACT

A machine for the production of paired chains including a feeding assembly for the chains, a welding assembly of the chains and a take-up device for the produced chain. The feeding assembly for the chains includes a transport mechanism thereof suitable for the engagement within corresponding side by side links and for realizing the simultaneous and intermittent advancement without modifying the symmetry of their reciprocal position with respect to the advancement axis. The transport mechanism, constituted in particular of needle-shaped members, is provided with a translational reciprocating motion in the advancement direction and of a reciprocating lifting and lowering motion in an orthogonal direction. The welding assembly, constituted of two equal assemblies in series, provides for the simultaneous movement of means delivering the welding flame and the welding material. The take-up device operates synchronously with the feed of the chains in order to maintain constantly taut the chain during the welding. Finally, a mechanism is provided for synchronizing the several operating steps of the apparatus and for the control of the operative sequence.

18 Claims, 7 Drawing Figures

MACHINE FOR THE PRODUCTION OF ORNAMENTAL CHAINS, IN PARTICULAR OF THE PAIRED TYPE

DESCRIPTION

The present invention has for its object a machine for the production of ornamental chains, in particular paired chains.

In the goldsmith industry, as it is well known, with the expression paired chain there is meant a chain obtained starting from two or more chains suitably welded to each other in the contact points of their side by side links, these starting chains being fed to the subsequent welding in parallel one side to side to the other. A typical example of a paired chain is the so-called "Bismarck" chain obtained from the pairing in the above meant sense of two chains of the "forzatina" type, i.e. of the kind constituted of planar annular links connected in a regular sequence one to the other. In the attached FIG. 1 there has been illustrated, for clarification purpose a portion of paired chain of the "Bismarck" type, partially constructed, in order to bring in evidence the two "forzatina" type chains from the union of which the same is obtained.

The paired chains of the above mentioned kind are presently produced with almost exclusively manual processes. The starting chains are unwound from suitable braked coils and placed parallel to each other within a guide so that they are symmetrically side by side i.e. in such a way so that the relative position of the side by side links to be welded does not change in whatsoever moment. The welding is performed in a conventional way with the help of a flame for melting small portions of a welding wire placed in correspondence with the contact points of corresponding side by side links. Owing to the geometrical structure of the starting chains, in which indeed two subsequent links engaged the one in the other lie in two planes substantially crossed to each other, it is clear that putting side by side two chains of this kind, the contact points of corresponding links will lie alternately on two parallel planes, and consequently the welding will have to be made firstly on one face and then on the opposed face of the paired chain.

Several problems must be resolved in the realization of a machine for producing automatically the abovesaid kind of chains. A first problem concerns the automatization of the feed of the chains to be paired. Indeed, beside having to arrange for the simultaneous and intermittent advancement of the chains, one should provide so that the side by side links to be welded together be absolutely symmetrical to each other with respect to the median axis of the paired chain that, substantially, coincides with the advancement axis or direction. Clearly, a paired chain wherein the side by side links of the starting chains are offset, even sligtly even each other, would be aesthetically unacceptable. As a matter of fact, by the simple measurement of equal lengths of chains to be fed simultaneously, it is not possible, in general, to fulfil such condition, both because the links of a chain may show very small dimensional differences, for which reason to equal lengths of chains an asymmetrical advancement of side by side links may correspond, and because the known devices apt to realize this operation, apart from their high cost, do not guarantee the complete absence of slipping of the chains during their advancement and definitely do not assure the constance, within the required limits, of the length of the fed portions of chain.

A second problem concerns the automatization of the welding operation consisting in heating the spots to be welded, depositing over them a small portion of welding wire wetted beforehand with a deoxydizing agent, melting it and then to move away the flame and the not-melted wire. The most critical of these operations is the one concerning the deposit of the right amount of welding material and the prompt moving away of the not-melted material simultaneously with the moving away of the flame. The importance of the precision with which such operation is carried out is evident, being obvious that the consequences of an insufficient, or too large deposit of welding material or the moving away of the non-melted material when the molten part has already begun to solidify.

The apparatus according to the present invention, by resolving the above mentioned problems, makes possible the automatic production of paired chains with a consequent saving of labor and at the same time allows an appreciably higher production rate, under the same standard of quality, and definitely allowing the obtaining of a consistent saving in the production costs.

An important feature of the machine according to the invention consists in that for the automatic, simultaneous and intermittent, advancement of the chains, placed within suitable run guides, towards the welding unit, transport means for the chains are provided that, by exploiting the geometrical pattern thereof, are suitable for the engagement with corresponding side by side links of the same and are provided with a to and fro translational reciprocating motion in the advancement direction and a reciprocating lifting and lowering motion in a direction orthogonal to the advancement direction, the lifting motion being provided at the end of the forward stroke of the translational motion towards the welding unit, for allowing the disengagement from the links after the advancement of desired portions of the chains, the lowering motion being provided at the end of the return stroke of the translational motion, for allowing the engagement of the transport means with new corresponding side by side links. In particular, the transport means comprise, in their simplest and preferred embodiment, even if it is not limited thereto, a head, provided with the abovesaid motions, carrying needle-shaped members in a number corresponding to the number of the fed chains, orthogonal to the advancement direction of the same, and placed at a reciprocal distance that is related to the dimensions of the fed chains. In this way, since the reciprocal position of the needle-shaped members is fixed, these for transporting forward the chains, carry each time, in perfect alignment with each other the forward ends of the links within which thay are engaged, thus compensating, continuously, for possible slight dimensional differences of the links and assuring the constant side by side placement of the same.

According to another important feature of the machine conforming to the present invention, the approaching and moving away motions of the members delivering flame and welding material with respect to the spot where the welding has to be effected do occur simultaneously, being provided common actuating means for both. Moreover, the feed of the welding wire is obtained by means of an assembly having motor-driven small rollers that, through subsequent intermittent rotations according to a predetermined frequency, allow the advancement each time of a predetermined portion of welding wire to be deposited over the spots to be welded.

According to a further characteristic of the apparatus which is the object of the present invention, means are provided for the take-up of the produced chain that are syncronized with the feed of the starting chains, so that, for every portion of said chains that is fed, a corresponding portion of the produced chain is simultaneously wound on the take-up coil. Consequently the chain will remain constantly taut while the welding of the side by side links is performed.

Further characteristics, as well as advantages, of the apparatus according to the present invention will result more clearly from the description of an embodiment thereof as a non limitative example, made with reference to the attached drawings, wherein.

Figure 2:
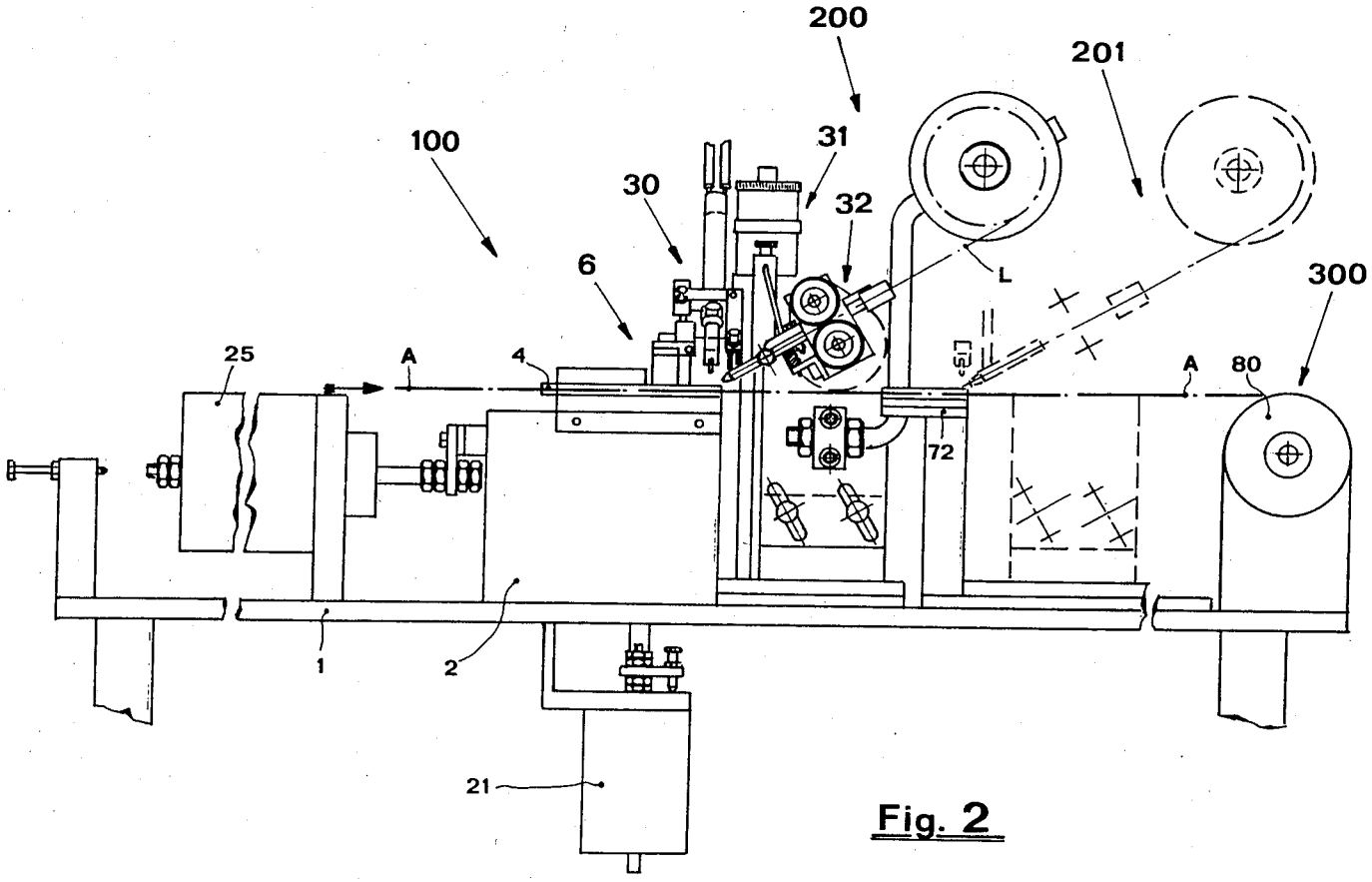
FIG. 2 shows in lateral elevational view an overall view of the machine according to the present invention.

With reference to FIG. 2, an apparatus for the production of paired chains according to the present invention includes a feed assembly for the chains, generally indicated as 100, along an advancement direction A, identified with a dotted and dashed line, two welding assemblies for the chains, generally shown as 200 and 201, equal each other and placed in series, for performing the welding of the side by side links located, as previously explained, on the two opposite faces of the paired chain, and then as has been generally indicated at 300 a take-up device for the produced chain. The above described assemblies are mounted on a horizontal base plane 1 of the apparatus located over a suitable structure.

Figure 3:
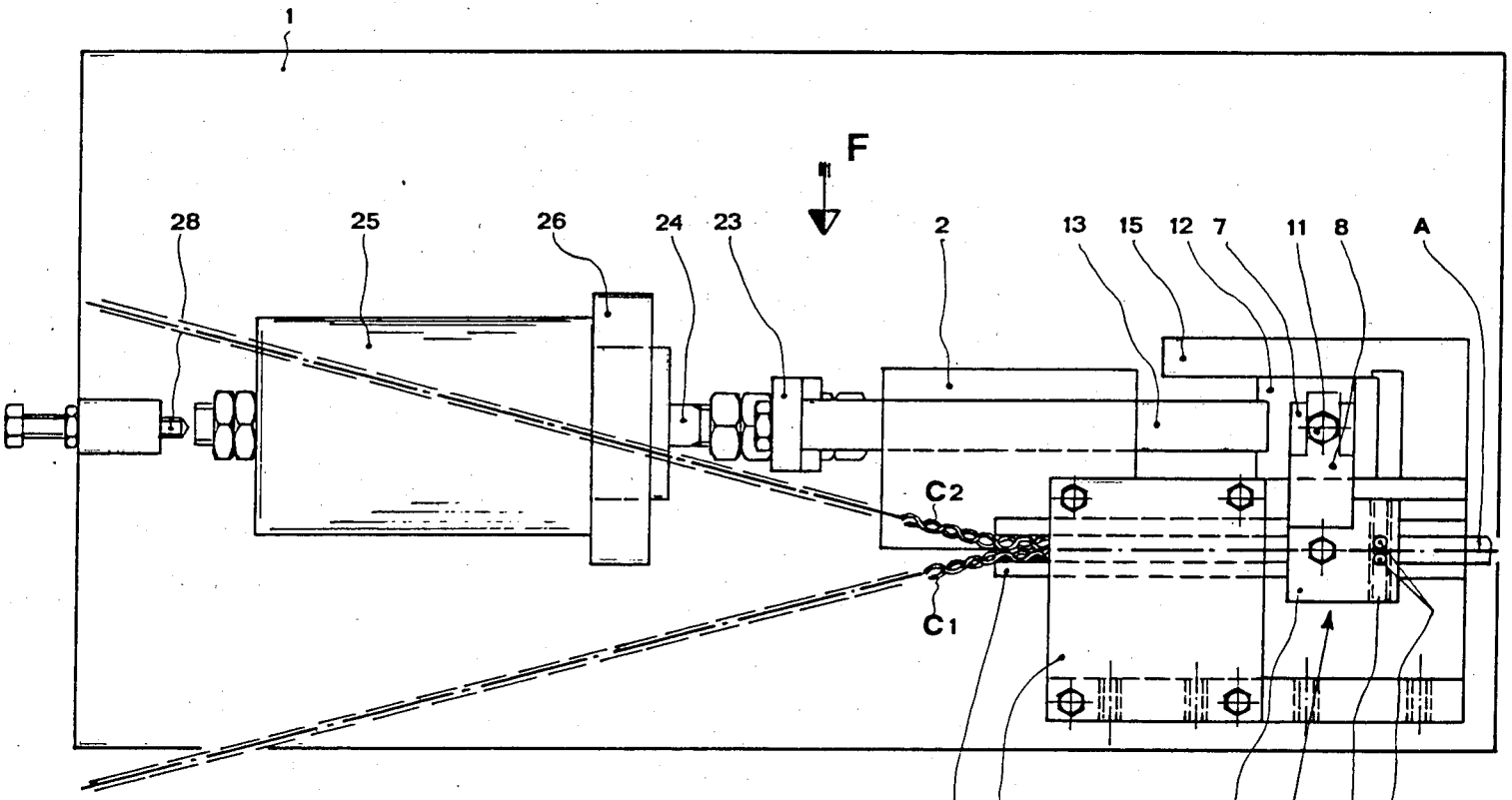
FIG. 3 is a top plan view of the feed device for the chains.
Figure 4:
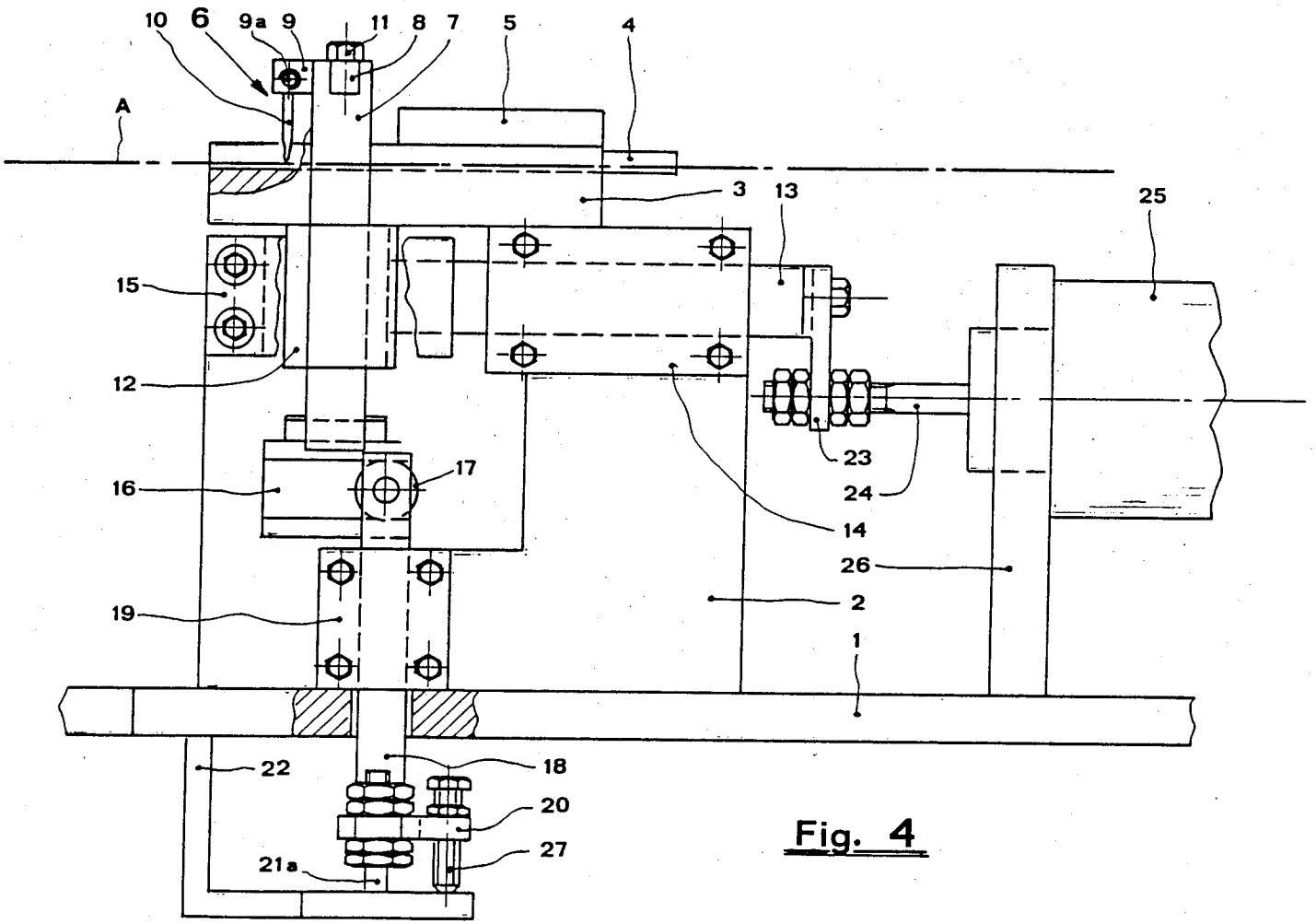
FIG. 4 is a partially enlarged lateral elevational view of the feed device as seen in the direction of the arrow F of FIG. 3.

With reference to FIGS. 3 and 4, wherein the feed assembly has been shown relating to two chains C1 and C2, coming from two separate braked coils of a conventional type, not shown, there has been indicated at 2 a support base, fastened to the base plane 1, above which a housing base 3 is located for a guideway 4 of the two chains C1 and C2. In the guideway 3 the chains C1 and C2 are placed in a side by side relationship and aligned along the advancement direction A. The guideway 4 is blocked at its housing base 3 by means of a upper plate 5. The base 2 operates also as a support for transport means for the chains C1 and C2, generally shown in 6, and placed in correspondence with the exit end of the guideway 4. The transport means includes substantially a vertical slide 7, extending laterally with respect to the guideway 4 and in closely spaced relationship with its exit end for the chains; at the upper end of the slide 7 there is fastened in an adjustable way a horizontal arm 8 extending up to above the guideway 4 and carrying in register therewith a head 9 whereon two sharpened pins 10 are fixed, by means of a suitable transversal pin 9*a*, laying on a vertical plane orthogonal to the advancement direction A of the chains C1 and C2 and directed towards the guideway 4 with their sharpened ends. The dimensions of the sharpened pins 10 are such as to allow the engagement of each of them with a link of the underlying chain C1 or C2. In order to adjust the position of the sharpened pins 10 with respect to the guideway 4, the arm 8 may be made to slide laterally with respect to the slide 7 and may be locked into the desired position by means of a screw 11.

The slide 7 is slidingly mounted within a corresponding movable vertical guideway 12, that is fastened to the end of a horizontal slide 13 slidable on its turn within a guideway provided for this purpose and fastened to the base 2 of the device. The movable guideway 12 of the slide 7 is placed in sliding contact with two opposed and ground walls of the base 2 and with a square plate 15 fastened to the base 2. At the lower end of the guideway 7 there is fastened a horizontal tubular guideway 16 within which a smaller roller 17 is slidingly engaged, that is placed at the end of a further slide 18, slidable within a fixed vertical guideway 19, and connected by means of an arm 20 to the plunger 21*a* of an electromagnet shown in FIG. 2, located under the base plane 1 of the device and supported by it by means of a bracket 22. The horizontal slide 13 is further connected by means of an arm 23 to the plunger 24 of an electromagnet 25 fastened to the base plane 1 by means of a support 26.

Through the above described connections the transport means 6 of the chains is provided with a double reciprocating motion: the first one in a horizontal sense, i.e. in the advancement direction A of the chains, controlled by the electromagnet 25 which causes the horizontal sliding motion of the slide 13 of the movable guideway 12 making the vertical slide 7 therewith engaged to translate to and fro, while the articulation constituted of the horizontal guideway 16 and of the roller 17 ensures the possibility of sliding motion of the slide 17 itself with respect to the slide 19; the second motion in a direction orthogonal with respect to the direction of advancement A of the chains is controlled by the second electromagnet 21 that, by means of the slide 19 articulated with the slide 7, causes the lowering or lifting of the sharpened pins 10 with respect to the guideway 4 for the chains.

The two electromagnets controlling the reciprocating motions as above are actuated in a synchronized manner by means of electric pulses applied according to a predetermined time sequence. Firstly the sharpened pins 10 are lowered for their engagement with the respective side by side links of the underlying chains at the exit end of the guideway 4, then the whole group 6 with the sharpened pins 10 engaged with the respective links is made to advance in the direction A for a space corresponding to the length of chain that has to be fed; then the pins 7 are lifted for disengaging them from the links and then the return motion of the same is commanded in the direction A for bringing them back in the starting position. These motions are intermittent and occur according to a time sequence that is a function of the operations to be performed downstream of the feed assembly and in particular it is conditioned by the welding times. The amplitude of the respective sliding motions of the plungers 21*a* and 24 of the two electromagnets are suitably adjusted according to the needs by means of respective adjustment screws 27 (FIG. 4) and 28 (FIG. 3).

The guideway 4 of the chains and the head 9 carrying sharpened pins may be easily substituted for adapting the feed assembly to various production needs, for instance for feeding a different number of chains or for feeding a different dimension chains.

Figure 1:
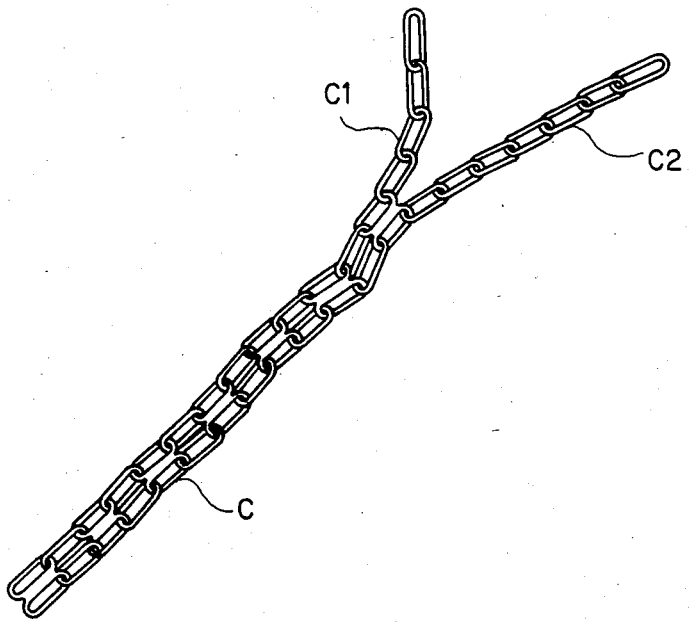
FIG. 1 shows a type of chain that may be produced with the apparatus according to the invention and the relative starting chains.
Figure 5:
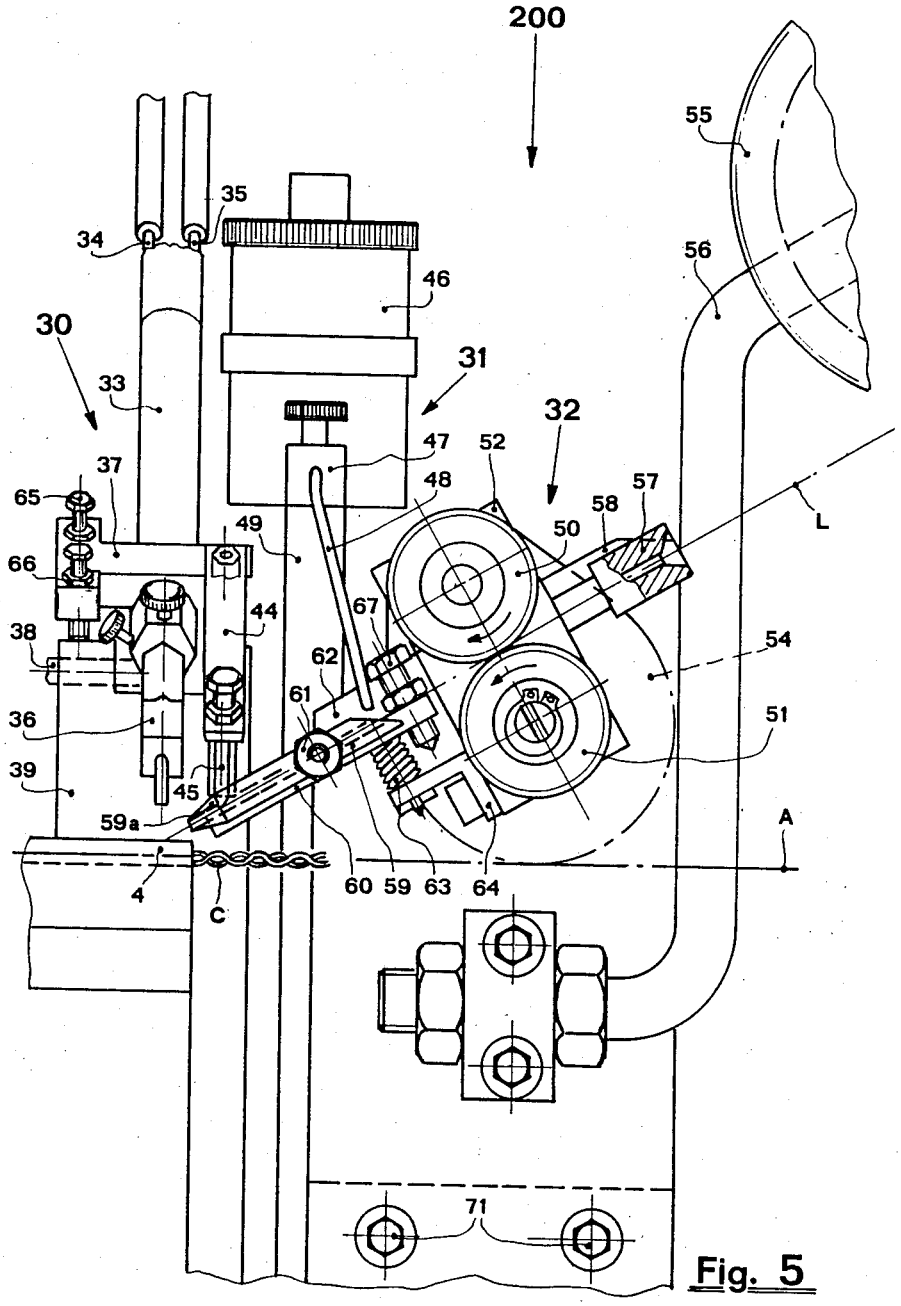
FIG. 5 is a lateral enlarged view of the welding assembly for the chains.
Figure 6:
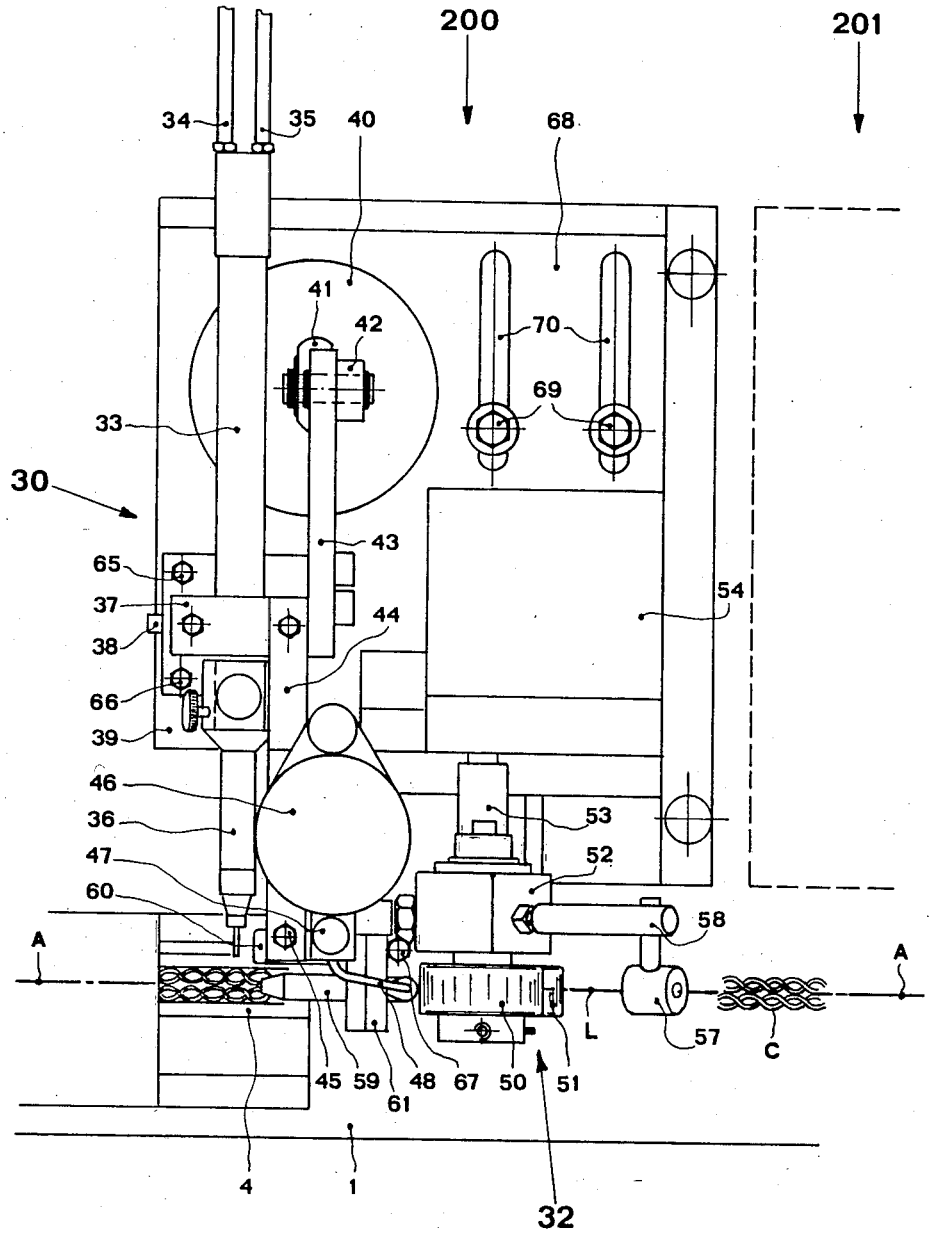
FIG. 6 is a top plan view of the assembly of FIG. 5.

The unit for the welding of chains, comprising two assemblies placed in series and indicated with 200 and 201 in FIG. 1, is illustrated in detail in FIGS. 5 and 6. In the abovesaid figures and in the following description only the assembly indicated with 200 will be illustrated of the welding assembly, the other assembly (201) being identical to the first one. The welding unit 200 comprises essentially an assembly 30 for providing the flame necessary for the welding, an assembly 31 the controlled delivery of a deoxydizing liquid and an assembly 32 for the supply of small portions of a welding wire.

The unit 30 is constituted of a torch 33 provided with connections 34 and 35 with the fuel tanks and carrying at its ends a nozzle 36 for the delivery of the flame. The torch 33 is fastened to a support 37 that by means of a horizontal pivot 38 (shown dotted in FIG. 5) is rotatably mounted on a fixed support 39. The rotation of the assembly 30 with respect to the support 39, with which there is obtained the approaching or the moving away of the torch 36 with respect to the chain C that is located on the corresponding guideway 4 is controlled by an electromagnet 40 (see FIG. 6) the plunger of which is connected by means of an articulation 41 to a vertical arm 42 connected to a horizontal arm 43 fastened to the support 37 of the torch 33. The outcoming and the return of the plunger of the electromagnet 40 cause a corresponding pivoting rotation of the arm 43 about the pivot 38 and the consequent pivoting rotation of the assembly 30 about the same pivot. On the support 37 there is fixed also a further arm 44 that extends forward parallel to the nozzle 36 with the free end of which an adjustment screw 45 is engaged, the function of which will be explained hereinafter.

The assembly for the deoxydizing liquid 31 comprises substantially a reservoir 46 provided with a valve 47 for metering the quantity of delivered liquid through a small delivery tube 48. The reservoir 46, which is placed side by side with the nozzle 36, is supported by a bracket 49 fixed with respect to the plane 1 of the machine.

The assembly 32 for the supply of the welding wire, indicated by L and with dotted and dashed line in FIG. 5, comprises two motor-driven small rollers 50 and 51 contacting each other the operative plane of which is constituted by the plane where the advancement direction A of the chain C lies. The small rollers 50 and 51 are supported by a support 52 and connected by means of the joint 53 to a constant-speed motor unit 54, for instance a DC motor. The motor 54 is energized by means of intermittent electrical pulses according to a predetermined time sequence imparting in this way intermittent rotations to the small rollers 50 and 51. The welding wire L, that is progressively unwound from a braked coil 55 (see FIG. 5) supported by a support arm 56, is directed towards the small rollers 50 and 51 by means of a guide 57 located upstream thereto, supported by a bracket 58 fastened to the support 52 of the small rollers. The wire L extends from the guideway 57 between the small rollers 50 and 51 that are in forced contact with each other, and consequently for each rotation thereof a predetermined length of wire that is advanced will correspond. Downstream of the small rollers 50 and 51 there is provided a tubular guideway 59 receiving the wire L outcoming from the rollers and directing it towards the spot where the welding has to be effected. The guideway 59 is integral with a bracket 60 placed parallel thereto and both are provided by means of the pivot 61 onto a fixed support 62. The end of the bracket 60 that is located side by side with the exit orifice 59*a* of the tubular guideway 59 cooperates with the tip of the adjustment screw 45 of the arm 44 against the force of a helical spring 63 located between the pivot 61 and the other end of the bracket 60 and fixed to a wing 64 fastened to the support 62 of the small rollers 50 and 51. Since the arm 44 moves integrally with the nozzle 36, the screw 45, by acting against the bracket 60 and overcoming the reaction of the spring 63, causes the rotation of the same around the pivot 61, so that the nozzle 36 and the tubular guideway 59 lower at the same time towards the guideway 4 of the chain C. In a similar way, when the portion of wire L deposited on the spot to be soldered has been melted, the arm 44 lifts integrally with the nozzle 36 causing the immediate lifting of the tubular guideway 59, since the bracket 60, no more pushed by the screw 45, is subjected to the return action of the spring 63. The angular displacements both of the torch 33 and of the tubular guideway 59 are adjusted by means of suitable adjustment screws: for the torch 33 the adjustment screws 65 and 66 are provided that operate against the support 39 of the assembly, while for the tubular guideway 59 the adjustment guideway 67 is provided located at the end of the bracket 60 that operates against the wing 64. The tube 48 delivering deoxydizing liquid coming from the reservoir 47 is arranged in such a way so as to deliver dropwise the liquid in correspondence with the entry mouth of the tubular guideway 59. The whole welding assembly 200 is mounted on its own support 68 the positioning of which is adjustable with respect to the base 1 of the apparatus by operating on the adjustment screws 69 located in the slots 70 and on the adjustment screws 71.

The welding assembly indicated in 201 and placed downstream of the assembly 200, as abovesaid is identical to the previous one and operates for welding the links of the chain C that are side by side on the other face. In order to put upside down the chain it is clearly sufficient that between the feed and take-up of the same a torsion of 180° be introduced; the overturning occurring in the guideway 72 (shown in FIG. 2) that is provided for along the advancement direction A between the two welding assemblies 200 and 201.

Figure 7:
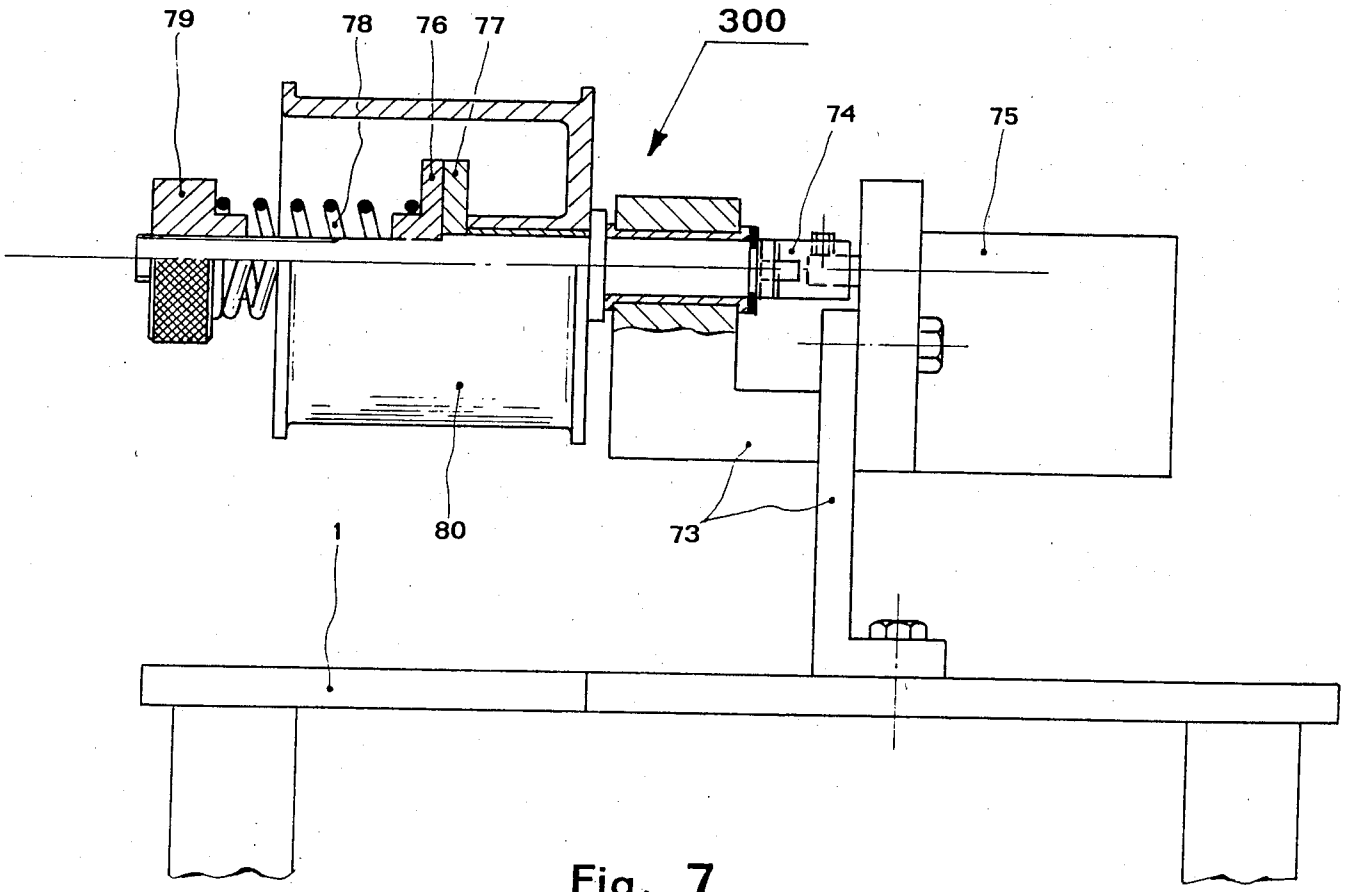
FIG. 7 is a lateral view of the take-up assembly of the produced chain.

For the take-up of the produced chain and at the same time for maintaining it conveniently taut, downstream of the welding assemblies 200 and 201 there is provided the device generally indicated in 300 and shown into detail in FIG. 7. The device in question comprises a take up bobbin or roller 80 rotatably supported in a support 73 fastened to the plane 1 of the machine and connected by means of a joint 74 to a constant speed motor unit 75, for instance a D.C. one. The roller 80 is suitably braked by means of a conventional arrangement comprising the two disks 76 and 77 maintained in a forced contact by the action of the spring 78 conveniently adjustable by acting on the knob 79. The motor 75 is energized in an intermittent way by means of electrical pulses synchronous with those that are sent to the feed device of the chains so that for every portion of the chains C1 and C2 that are fed an equal portion of the chain C will correspond that is wound on the roller 80. In this way the advancement motion produced by the feed assembly of the chain 100 is compensated and the chain is therefore maintained constantly taut along the subsequent welding assembly 200 and 201.

For the synchronization and control of the various operative steps of the apparatus according to the invention centralized programmable means are provided that produce sequences of electrical pulses for the several motors and electromagnets. A typical operative sequence for the machine according to the present invention is the following one:

a first electrical pulse sent to the electromagnet 21, causes the lowering of the sharpened pins 10 and the engagement of these latter with corresponding side by side links of the chains C1 and C2 located in the guideway 4;

a second electrical pulse sent to the electromagnet 25 causes the advancement of the transport means 6 of the chains for a predetermined length; at the same time a parallel pulse energizes the motor 75 of the take up device 300 causing a rotation of the bobbin 80 and the consequent winding of a corresponding portion of chain C;

the sharpened pins 10 lift and disengage themselves from the respective links;

the transport means 6 return to the initial position;

a pulse sent to the electromagnet 40 causes the contemporaneous lowering of the nozzle 36 and of the tubular guideway 59 of the welding wire L towards the guideway 4;

a dead time for the pre-heating of the parts to be welded;

the motor 54 is energized causing the rotation of the small rollers 50 and 51 that on their turn cause the advancement of a small portion of welding wire that, deposited on the spot to be welded, is melted almost immediately;

the abrupt lifting of the nozzle 36 and of the guideway 59 with a detachment of the fused from the not fused one of the wire L.

At this time the above described operative sequence is repeated. Clearly the welding steps above described for the welding assembly 200 occur contemporaneously also in the assembly 201.

Changes and/or modifications may be introduced in the apparatus for the production of ornamental chains of the paired type as above described and illustrated without departing for this from the scope of protection of the invention itself.

We claim:

1. An apparatus for the production of ornamental chains of the paired type, comprising:

a feed assembly for at least two chains comprising a run guideway for said chains suitable for alinging them in side by side relationship along common advancement direction, transport means for said chains suitable for engaging the chain themselves on fixed locations determined by their geometrical pattern and means suitable for imparting to said transport means a to and fro reciprocating translational motion in the advancement direction and a reciprocating lifting and lowering motion in a direction orthogonal to the advancement direction, said lifting motion being provided at the end of the forwarding stroke of said translational motion, for allowing the disengagement from the links after the advancement of desired lengths of chain, said lowering motion being provided at the end of the return stroke of said translational motion for allowing the engagement of said transport means with new side by side corresponding links;

a welding assembly for welding the side-by-side links, first on one face, then on an opposite face thereof positioned downstream of said feeding assembly of the chains, comprising means for the delivery of deoxydizing liquid, means for the delivery of small portions of welding wire and flame delivery means for providing the necessary heat for the heating of the parts to be welded and for the melting of the wire, there being provided means for imparting to said means delivering flame and welding wire a simultaneous approaching motion towards the parts to be welded and a subsequent simultaneous moving away movement;

a take-up device of the produced chain, downstream of said welding assembly, suitable for operating synchronously with said feeding assembly, for the takeup of portions of produced chain having a length equal to the portions of chain contemporaneously advanced by said feeding assembly, so that on the chain a constant and predetermined tensile stress is maintained;

programmable centralized sequencer means for the control and synchronization of said assembly for feeding the chains, of said welding assembly and of said take up device of the produced chain.

2. An apparatus according to claim 1, wherein said transport means for the chain are located in correspondence with the exit end of said guideway and comprise a head, provided with the abovesaid reciprocating motions, and carrying needle-shaped members located orthogonal to the advancement direction and suitable for the engagement with corresponding links of the chains and underlying them.

3. An apparatus according to claim 2, in which said needle-shaped means comprise parallel sharpened pins that lie in a plane orthogonal to the advancement direction and in a number equal to the one of the chains to be advanced.

4. An apparatus according to claim 2 wherein said head carrying said sharpened pins is integral with a first vertical slide slidably mounted within a corresponding movable guideway slidable in a horizontal sense.

5. An apparatus according to claim 1, wherein said means for imparting said reciprocating motions to said transport means for the chains, include means actuating the two reciprocating motions respectively connected to a horiziontal slide carrying said movable guideway and a second vertical slide connected through an articulated connection to said first vertical slide, said articulated connection being suitable to allow the translation of the first slide with respect to the second parallel to itself in the advancement direction of the chains.

6. An apparatus according to claim 5, wherein said articulated connection comprises a horizontal guideway integral with said first vertical slide and a roller slidingly engaged within said guide and integral with said second vertical slide.

7. An apparatus according to claim 5, wherein said actuating means for said reciprocating motions is constituted of electromagnetic devices.

8. An apparatus according to claim 2, wherein the head carrying said needle-shaped members is adjustable with respect to said first vertical slide and is replaceable.

9. An apparatus according to claim 1 wherein said guideway for the chains is replaceable.

10. An apparatus according to claim 1, wherein said means for imparting to said delivery means for the flame and the welding wire a simultaneous motion of approach to the parts to be welded and a subsequent moving away movement comprise an arm integral with said flame delivery means cooperating with a bracket integral with said tubular guide for the welding wire, in order to cause the lowering of this latter concurrently with the lowering of said flame delivery means towards the chain to be welded, said arm operating on said flame against elastic means suitable for commanding the lifting of a tubular guide downstream of said rollers concurrently with the lifting of said flame delivery means.

11. An apparatus according to claim 10, wherein said arm is connected in an articulated manner with means actuating an intermittent reciprocating motion.

12. An apparatus according to claim 11, wherein said means actuating an intermittent reciprocating motion are constituted of an electromagnet.

13. An apparatus for the production of ornamental chains of the paired type, comprising:

a feeding assembly for at least two chains comprising a run guideway for said chains suitable for aligning them in side by side relationship along a common advancement direction, transport means for said chains suitable for engaging the chain themselves on fixed locations determined by their geometrical pattern and means suitable for imparting to said transport means a to and fro reciprocating translational motion in the advancement direction and a reciprocating lifting and lowering motion in a direction orthogonal to the advancement direction, said lifting motion being provided at the end of the forwarding stroke of said translational motion, for allowing the disengagement from the links after the advancement of desired lengths of chain, said lowering motion being provided at the end of the return stroke of said translational motion for allowing the engagement of said transport means with new side by side corresponding links:

a welding assembly for welding the side by side links, first on one face then on an opposite face thereof, positioned downstream of said feeding assembly of the chains, comprising means for the delivery of deoxydizing liquid, means for the delivery of small portions of welding wire and flame delivery means for providing the necessary heat for the heating of the parts to be welded and for the melting of the wire, there being provided means for imparting to said means delivering flame and welding wire a simultaneous approaching motion towards the parts to be welded and a subsequent simultaneous moving away movement;

a take-up device of the produced chain, downstream of said welding assembly, suitable for operating synchronously with said feeding assembly, for the take-up of portions of produced chain having a length equal to the portions of chain contemporaneously advanced by said feeding assembly, so that on the chain a constant and predetermined tensile stress is maintained;

programmable centralized sequencer means for the control and synchronization of said assembly for feeding the chains, of said welding assembly and of said take up device of the produced chain, said welding assembly comprising first and second welding subunits for welding the side-by-side links first on one face thereof, then on an oppoiste face thereof respectively, said second welding subunit being positioned downstream from said first welding subunit, each of said first and second welding subunits comprising sub-means for the delivery of deoxydizing liquid, sub-means for the delivery of small portions of welding wire and flame delivery sub-means for providing the necessary heat for the heating of the parts to be welded and for the melting of the wire, there being provided sub-means for imparting to said means delivering flame and welding wire a simultaneous approaching motion towards the parts to be welded and a subsequent simultaneous moving away movement.

14. The device of claim 13, comprising a means for causing a 180° twist of a welding pair of chains comprising a portion of said run guideway between said first and second welding sub-units.

15. An apparatus for the production of ornamental chains of the paired type, comprising:

a feeding assembly for at least two chains comprising a run guideway for said chains suitable for aligning them in side by side relationship along a common advancement direction, transport means for said chains suitable for engaging the chain themselves on fixed locations determined by their geometrical pattern and means suitable for imparting to said transport means a to and fro reciprocating translational motion in the advancement direction and a reciprocating lifting and lowering motion in a direction orthogonal to the advancement direction, said lifting motion being provided at the end of the forwarding stroke of said translation motion, for allowing the disengagement from the links after the advancement of desired lengths of chain, said lowering motion being provided at the end of the return stroke of said translational motion for allowing the engagement of said transport means with new side by side corresponding links:

a welding assembly for welding the side by side links, first on one face then on an opposite face thereof, positioned downstream of said feeding assembly of the chains, comprising means for the delivery of deoxydizing liquid, means for the delivery of small portions of welding wire and flame delivery means for providing the necessary heat for the heating of the parts to be welded and for the melting of the wire, there being provided means for imparting to said means delivering flame and welding wire a simultaneous approaching motion towards the parts to be welded and a subsequent simultaneous moving away movement;

a take-up device of the produced chain, downstream of said welding assembly, suitable for operating synchronously with said feeding assembly, for the take-up of portions of produced chain having a length equal to the portions of chain contemporaneously advanced by said feeding assembly, so that on the chain a constant and predetermined tensile stress is maintained;

programmable centralized sequencer means for the control and synchronization of said assembly for feeding the chains, of said welding assembly and of said take up device of the produced chain, wherein, said feeding means for the welding wire comprises a pair of motor-driven small rollers, in rolling contact, provided with a rotational intermittent motion under constant speed and a tubular guideway downstream of said rollers, said wire extending between said small rollers and along said guideway and advancing towards the parts to be welded for a portion of predetermined length in correspondence with each intermittent rotation of said small rollers.

16. An apparatus according to claim 15, wherein said flame delivery means and said tubular guideway for the welding wire are rotatably mounted on separate fixed horizontal pivots, one parallel to and one orthogonal to the advancement direction of the chain.

17. An apparatus according to claim 15, wherein said flame delivery means include a torch and a delivery nozzle, said torch being carried by a rotatable support around said fixed horizontal pivot, said electromagnet having its plunger articulation connected with an arm parallel and integral with said rotatable support and extending up to said bracket intregral with the tubular guideway of the welding wire, in said bracket acting in contrast each other said arm and a return spring.

18. An apparatus for the production of ornamental chains of the paired type, comprising:

a feeding assembly for at least two chains comprising a run guideway for said chains suitable for aligning them in side by side relationship along a common advancement direction, transport means for said chains suitable for engaging the chain themselves on fixed locations determined by their geometrical pattern and means suitable for imparting to said transport means a to and fro reciprocating translational motion in the advancement direction and a reciprocating lifting and lowering motion in a direction orthogonal to the advancement direction, said lifting motion being provided at the end of the forwarding stroke of said translational motion, for allowing the disengagement from the links after the advancement of desired lengths of chain, said lowering motion being provided at the end of the return stroke of said translational motion for allowing the engagement of said transport means with new side by side corresponding links:

a welding assembly for welding the side by side links, first on one face then on an opposite face thereof, positioned downstream of said feeding assembly of the chains, comprising means for the delivery of deoxydizing liquid, means for the delivery of small portions of welding wire and flame delivery means for providing the necessary heat for the heating of the parts to be welded and for the melting of the wire, there being provided means for imparting to said means delivering flame and welding wire a simultaneous approaching motion towards the parts to be welded and a subsequent simultaneous moving away movement;

a take-up device of the produced chain, downstream of said welding assembly, suitable for operating synchronously with said feeding assembly for the take-up of portions of produced chain having a length equal to the portions of chain contemporaneously advanced by said feeding assembly, so that on the chain a constant and predetermined tensile stress is maintained:

programmable centralized sequencer means for the control and synchronization of said assembly for feeding the chains, of said welding assembly and of said take up device of the produced chain, wherein, said take-up device for the produced chain includes a take-up coil and constant-speed motor means for imparting to said coil subsequent intermittent rotations, each rotation having such an amplitude so as to cause the winding on said coil of a portion of produced chain having a length equal to the one of portions of chains contemporaneously fed.

* * * * *